US007721816B1

(12) United States Patent
Wilson et al.

(10) Patent No.: US 7,721,816 B1
(45) Date of Patent: May 25, 2010

(54) DRILLING/BOLTING MACHINE HAVING A MANUAL OPERATOR INPUT DEVICE WITH ENABLE SWITCH AND RELATED METHODS

(75) Inventors: Henry E. Wilson, Ironton, OH (US); Craig M. Collins, Proctorville, OH (US)

(73) Assignee: J.H. Fletcher & Co., Huntington, WV (US)

( * ) Notice: Subject to any disclaimer, the term of this patent is extended or adjusted under 35 U.S.C. 154(b) by 1208 days.

(21) Appl. No.: 10/887,245

(22) Filed: Jul. 8, 2004

Related U.S. Application Data

(60) Provisional application No. 60/485,566, filed on Jul. 8, 2003.

(51) Int. Cl.
*E21B 7/00* (2006.01)

(52) U.S. Cl. ..... 173/1; 173/2; 173/4

(58) Field of Classification Search ..... 173/1, 173/2, 4, 213; 74/335; 345/161
See application file for complete search history.

(56) References Cited

U.S. PATENT DOCUMENTS

| | | | | |
|---|---|---|---|---|
| 2,841,659 | A * | 7/1958 | Eitel | 200/5 R |
| 3,180,514 | A * | 4/1965 | Horton | 414/620 |
| 3,811,336 | A * | 5/1974 | Pulskamp | 74/471 XY |
| 4,028,958 | A * | 6/1977 | Schuermann et al. | 74/471 XY |
| 4,051,915 | A * | 10/1977 | Behrens | 180/271 |
| 4,157,467 | A * | 6/1979 | Koeper | 377/31 |
| 6,053,258 | A * | 4/2000 | Shimada et al. | 173/2 |
| 6,501,198 | B2 | 12/2002 | Taylor et al. | |
| 6,580,418 | B1 * | 6/2003 | Grome et al. | 345/161 |
| 6,892,481 | B2 * | 5/2005 | Yamamoto et al. | 37/348 |
| 2001/0050186 | A1 * | 12/2001 | Wilson et al. | 175/38 |
| 2002/0157870 | A1 * | 10/2002 | Bischel et al. | 175/52 |
| 2003/0205409 | A1 * | 11/2003 | Koch et al. | 175/26 |

OTHER PUBLICATIONS

HGK "Joystick Enable Switch," P-Q Controls, Inc., Apr. 4, 2000, pp. 1-2, Bristol, CT.

* cited by examiner

*Primary Examiner*—Rinaldi I. Rada
*Assistant Examiner*—Nathaniel Chukwurah
(74) *Attorney, Agent, or Firm*—King & Schickli, PLLC

(57) ABSTRACT

This invention relates to the control of a machine for performing drilling or bolting operation, such as in an underground mine. In one aspect, the invention comprises a system including an input device for manually controlling at least one aspect of the drilling or bolting operation and a controller associated with at least one neutral switch. An actuator actuates the drilling or bolting operation and includes a valve associated with the input device and the neutral switch. The input device is operative for controlling the drilling or bolting operation only when the valve is in a neutral position according to the neutral switch. Related input devices and methods are also disclosed.

31 Claims, 7 Drawing Sheets

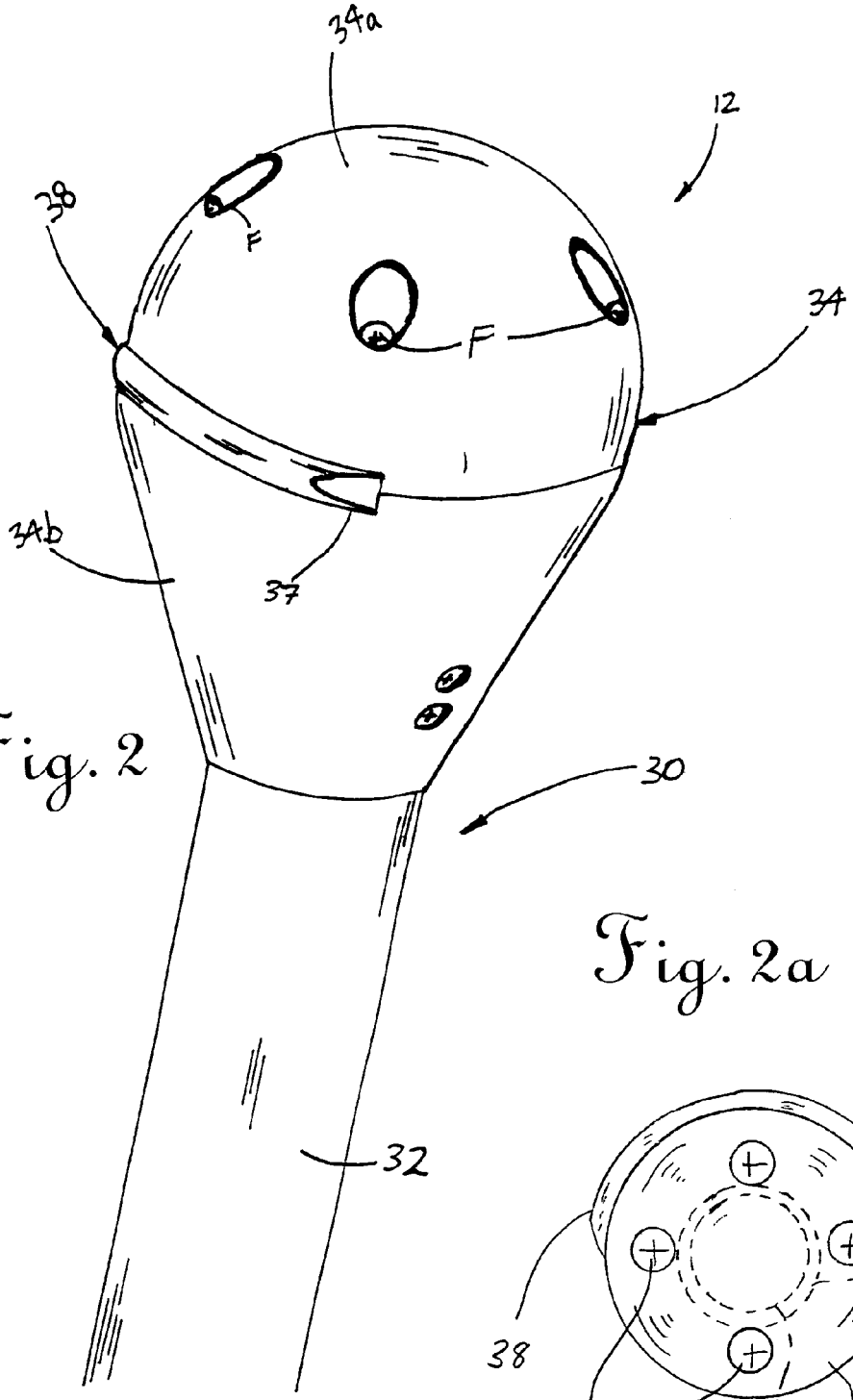
Fig. 2
Fig. 2a
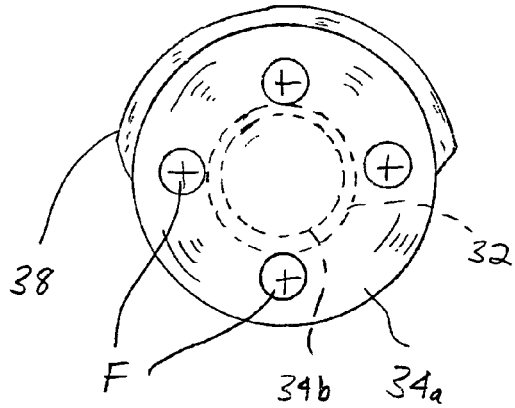

DRILLING/BOLTING MACHINE HAVING A MANUAL OPERATOR INPUT DEVICE WITH ENABLE SWITCH AND RELATED METHODS

This application claims the benefit of U.S. Provisional Application Ser. No. 60/485,566, filed Jul. 8, 2003, the disclosure of which is incorporated herein by reference.

TECHNICAL FIELD

The present invention relates to the drilling art and, more particularly, to a drilling or bolting machine including a control system having a manual operator input device for controlling at least one aspect of the drilling or bolting operation.

BACKGROUND OF THE INVENTION

Drills using rotatable bits for penetrating into the earth are in widespread use. One application of such drills is in conjunction with a machine known in the vernacular as a "roof bolter" capable of both forming boreholes in the faces of the passageways of underground mines and then installing roof anchors or "bolts" in the boreholes. As is well-known in the art, the bolts once installed provide support for the adjacent portion of the mine face (typically the roof and ribs), thereby reducing the incidence of catastrophic cave-ins.

In the typical bolting operation, once the borehole is created using the drill, a resin cartridge is inserted. The drill head is then used to insert a roof bolt into the borehole to rupture the resin cartridge. Once ruptured, the bolt is rotated using the drill head to mix the resin, which is designed to quickly set and form a secure bond with the material surrounding the borehole.

Oftentimes, a manual operator input device, such as a joystick, is used to control the operation of the drill head, both during the drilling and bolting cycles of the operation. A single joystick may be associated with a manual control valve such that movement in a first direction (i.e., forward) results in drill head feed, rotation, or both. Alternatively, two independent joysticks may be used: one for controlling feed and the other, rotation. Using a manual control valve also allows the speed and direction of rotation or feed to be easily controlled by simply pivoting the joystick. However, electronic, solenoid-operated proportional control valves may also be used, if desired.

While an input device such as a joystick provides an intuitive and easy-to-use interface for controlling the drilling and bolt insertion operations, it has been discovered that the operator sometimes inadvertently moves the input device (joystick) for causing rotation when only feed is desired. Likewise, the operator may desire to rotate the chuck at a slow speed to assist in coupling the bolt head with a wrench or socket in a drill "pot," but inadvertently move the joystick to a position such that a higher rotational speed results. Both of these occurrences essentially require the operator to repeat the procedure and, consequently, decrease the efficiency of the operation.

Accordingly, a need is identified for a manual input device or system for use in controlling a drilling operation, such as during the forming boreholes in one or more faces of a passageway in an underground mine. The input device would be simple to operate using only one hand, yet would prevent inadvertent actuation of the drill head (feed, rotation, or both). The input device would provide failsafe operation and would be tamper-resistant to prevent operator override. The input device would also be easily retrofitted onto existing drilling machines. The use of a neutral switch to prevent movement (tramming) of a drilling machine on power up is also disclosed.

SUMMARY OF THE INVENTION

In accordance with a first aspect of the invention, a system for controlling a drilling or bolting operation is disclosed. The system comprises an input device for manually controlling at least one aspect of the drilling or bolting operation, a controller associated with at least one neutral switch, and an actuator for actuating the drilling or bolting operation. The actuator includes a valve associated with the input device and the neutral switch. The input device is operative for controlling the drilling or bolting operation only when the valve is in a neutral position according to the neutral switch.

In one embodiment, the manual input device includes an enable switch associated with the controller. Preferably, the manual input device is operative for controlling the drilling or bolting operation only when the valve is in the neutral position and the enable switch is closed. However, it is also possible that the manual input device is operative for controlling the drilling or bolting operation only when the enable switch is closed before the valve is moved from the neutral position. In either case, the enable switch may be opened once the valve is moved from the neutral position with the enable switch closed without rendering the manual input device inoperative.

In another embodiment, the controller includes a circuit for evaluating whether the enable switch is open or closed at predetermined intervals. Using this circuit, the input device is rendered inoperative for controlling the drilling or bolting operation if the controller determines that the enable switch is closed for a predetermined number of intervals.

The manual input device is preferably a joystick associated with the valve and the enable switch is closed by a trigger associated with the joystick. The actuator preferably includes a valve package for selectively permitting a fluid flow to reach the valve once the controller determines that: (1) an enable switch associated with the input device is closed; and (2) the neutral switch is closed. In a more particular embodiment, the actuator includes at least one fluid-operated motor for controlling a feed or a rotation of either: (1) a drill bit for performing the drilling operation; or (2) a roof bolt used in the bolting operation.

In accordance with a second aspect of the invention, a manual input device for a drilling or bolting machine is disclosed. The device is designed for use by a single hand of an operator having a palm and fingers. The device comprises a support, a head associated with the support and including an upper portion and a lower portion defining an interface, and a low-profile trigger positioned adjacent the interface. The trigger includes a body having a generally semi-circular face for engagement by at least one of the operator's fingers when the palm is positioned on or generally adjacent the upper portion of the head. A switch for controlling some aspect of the drilling or bolting machine or its operation is also associated with the trigger.

In one embodiment, the upper portion of the head is hemispherical, the lower portion is frusto-conical, and the two portions are secured together using fasteners recessed in the upper portion. The face of the trigger is rounded from a top edge to a bottom edge of the body. A slot is defined at the interface and a portion of the trigger body projects through the slot in a home position and when the switch is in an open condition. A spring biases the trigger toward the home position, and the support is an elongated shaft pivotally mounted to a stable support structure.

In accordance with a third aspect of the invention, a different manual input device for use by a single hand of an operator having a palm and fingers is disclosed. The device comprises a support, a head associated with the support and including first and second separable portions defining an interface. A trigger is pivotally mounted adjacent the interface, and includes a magnet and a face for engagement by at least one of the operator's fingers when the palm is positioned on or generally adjacent the head. A magnetically-actuated switch is associated with the head and the magnet of the trigger in an actuated position. Accordingly, the presence of dust or water adjacent the head does not impair actuation of the switch by the trigger.

In accordance with a fourth aspect of the invention, a system for controlling a machine for use in performing a drilling or bolting operation is disclosed. The system comprises a fluid-operated motive device for moving the machine; a valve for controlling fluid flow to the motive device; an input device for manually controlling the position of the valve; and a neutral switch associated with the valve. The motive device is capable of moving the machine only when the valve is in a neutral position according to the neutral switch. In one embodiment, the input device includes an enable switch, and the motive device is capable of moving the machine only when the enable switch is closed before the neutral switch is closed.

In accordance with a fifth aspect of the invention, an input device for controlling a position of first and second valve spools is disclosed. The input device comprises a lever, a first ball joint supporting the lever, a first linkage connecting the lever to the first spool, and a second linkage connecting the lever to the second spool. Movement of the lever to and fro in a first direction results in corresponding movement of the first spool and movement in a second direction results in corresponding movement of the second spool.

In one embodiment, movement in the first direction and the movement in the second direction occur simultaneously. In another, movement in the first direction occurs before the movement in the second direction. Preferably, the first and second directions are generally perpendicular, but the first and second spools move generally parallel.

BRIEF DESCRIPTION OF THE DRAWINGS

FIG. 2 presents a side view of an operator input device forming another aspect of the invention;

FIG. 2*a* is a top view of the input device of FIG. 2;

DETAILED DESCRIPTION OF THE INVENTION

Figure 1:
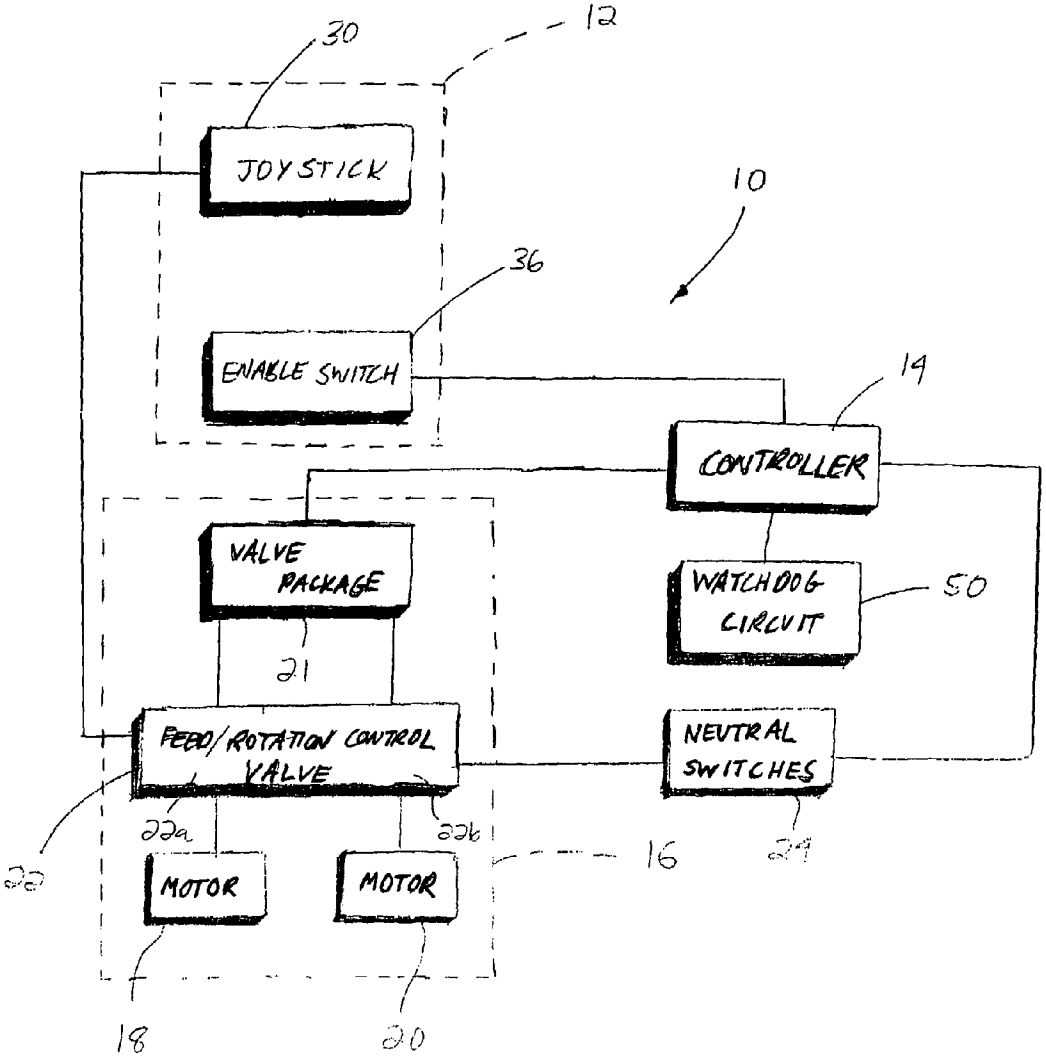
FIG. 1 schematically illustrates a control system forming one aspect of the invention.
Figure 3B:
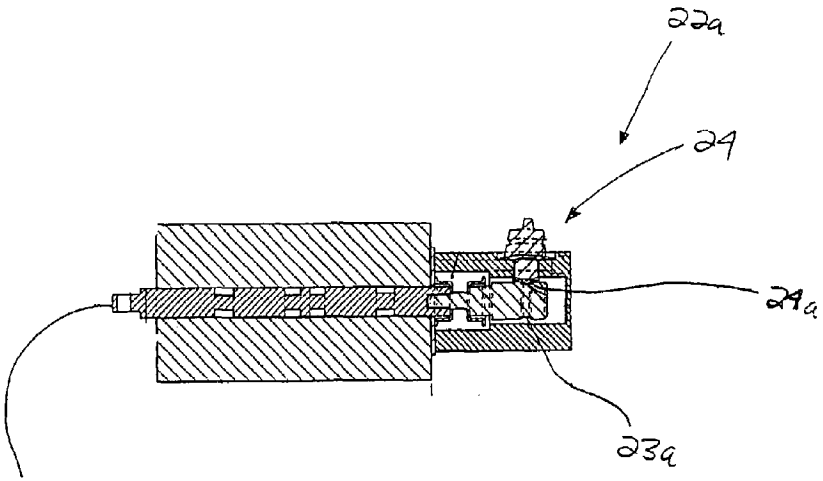
FIGS. 3*a*-3*d* present various views of a neutral switch for intended use in the control system of FIG. 1.
Figure 3D:
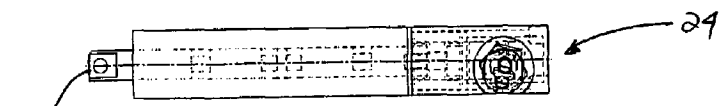
Figure 3A:
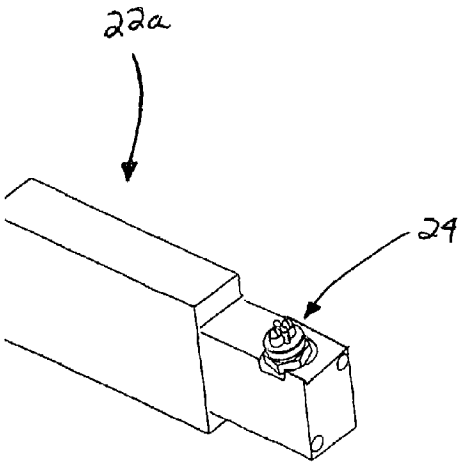
Figure 3C:
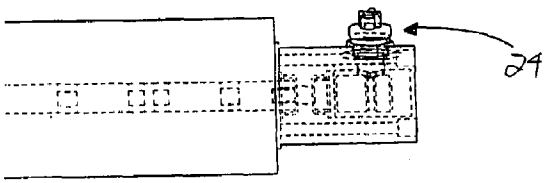
Figure 4A:
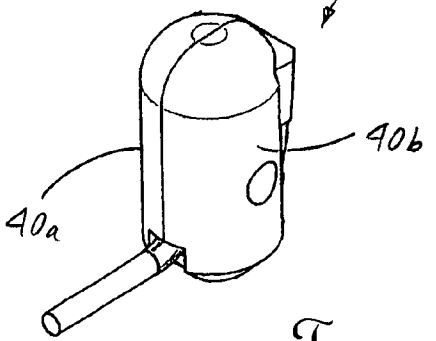
FIGS. 4*a*-4*d* present various views of another embodiment of an operator input device.
Figure 4B:
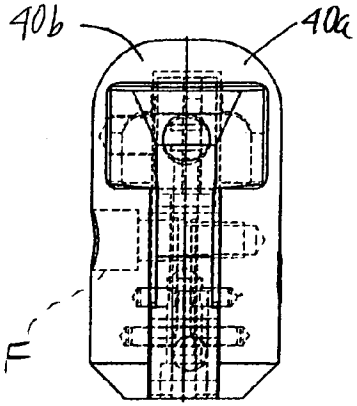
Figure 4C:
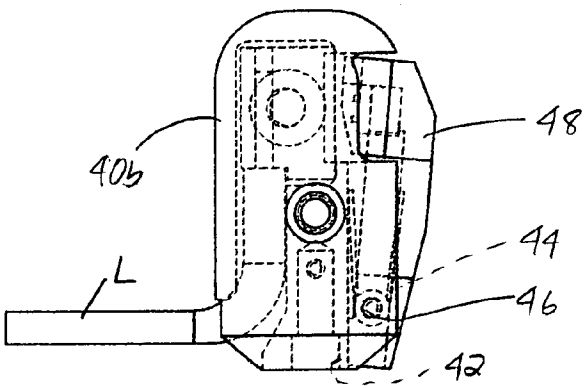
Figure 4D:
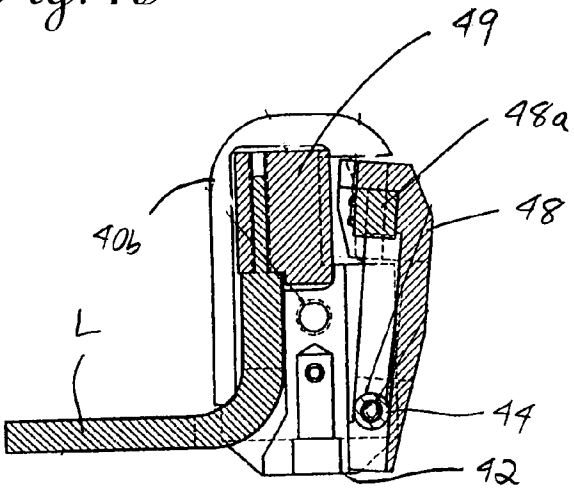

Reference is now made to FIG. 1, which schematically depicts a system 10 for manually controlling a drilling operation. In the illustrated embodiment, the system 10 includes a manual operator input device 12, such as a joystick capable of pivoting movement about at least one axis (see FIG. 2). As will be understood further upon reviewing the description that follows, the input device 12 controls at least one aspect of the drilling or bolting operation, such as the rotation of the drill head, the feed of the drill head, or the movement (tramming) of the corresponding machine to which the drill head is attached.

Figure 6B:
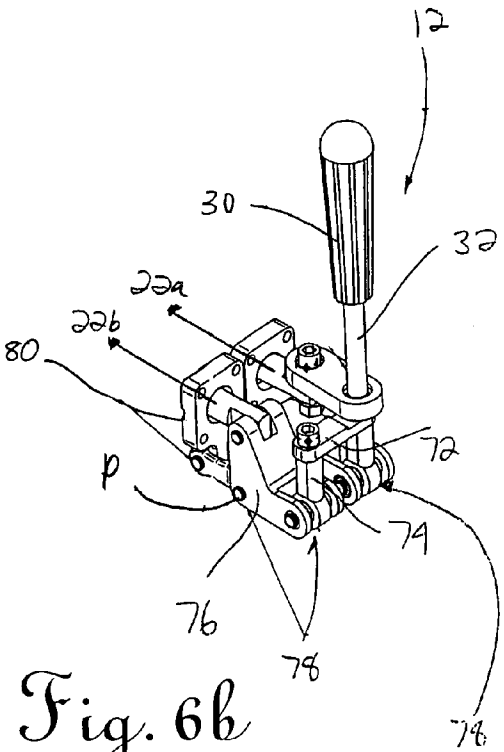
FIGS. 6*a*-6*e* present different views of yet another operator input device.
Figure 6A:
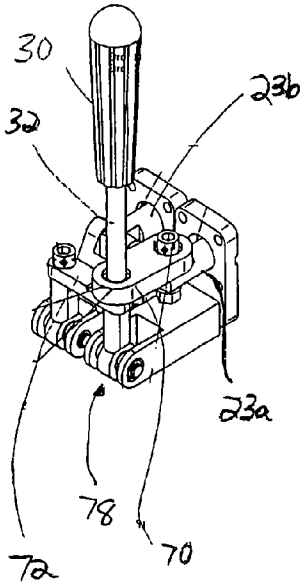
Figure 6E:
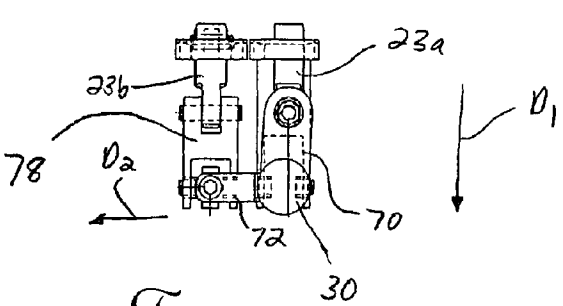
Figure 6D:
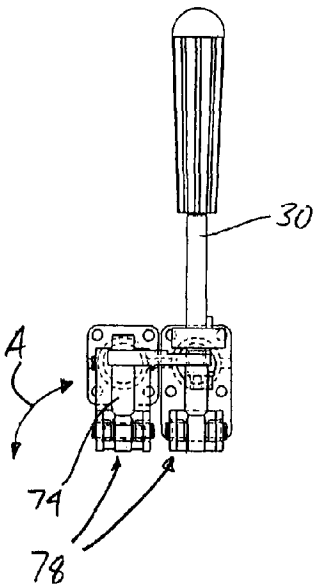
Figure 6C:
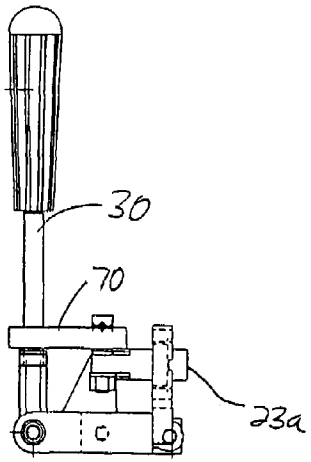

The system 10 further includes a controller 14 and an actuator 16 for actuating the drilling and/or bolting operation based on the manual input received, such as by rotating and feeding either a drill steel and bit into the earth to form a borehole or a roof bolt into the borehole once formed. In the illustrated embodiment, the actuator 16 includes separate fluid-operated motive devices or motors 18, 20 for providing the feed and rotational forces to the drill head (not shown). The fluid flow to the motors 18, 20 may be regulated or controlled by a valve package 21 (see FIG. 1) associated with manually operated feed and rotation control valve 22 (see FIG. 1) also forming part of the actuator 16. The valve 22 may include multiple sections 22*a* . . . 22*n* (see, e.g., FIGS. 6*a* and 6*b* and note directional arrows labeled 22*a* and 22*b*), each of which may control or regulate the flow of fluid to a single motor. For example, as shown in FIG. 1, the control valve 22 may include separate feed and rotation sections 22*a*, 22*b*.

A switch 24 is associated with the feed and rotation control sections 22*a*, 22*b* of the valve 22 and the controller 14. When open, the switch 24 indicates that the valve 22 (or, more specifically, the spool 23) is in the neutral position. These "neutral" switches 24 may be conventional position or proximity switches, various types of which are well known in the art, and may be positioned adjacent to the valve 22. An exemplary neutral switch 24 including a detent ball 24*a* seated in a circumferential groove 23*a* formed in the valve spool 23 of a single valve section 22*a* is shown in FIGS. 3*a*-3*d*. When the ball 24*a* is moved as the result of the translation of the spool 23 (which may be connected directly to the input device 12), a signal propagates to the controller 14 indicating that the valve 22 (or valve section 22*a* or 22*b*) is no longer in the neutral position.

The preferred embodiment of the input device 12 in the form of a joystick 30 is shown in FIG. 2. As noted above, the joystick 30 is mounted to a stable support structure (not shown) such that pivoting movement about at least one axis is permitted. The mounting is preferably such that the joystick 30 is normally held at or biased to a neutral position, with movement in two opposite directions overcoming the biasing force and manually opening the control valve 22. The biasing force is preferably such that it may be easily overcome by the operator, but sufficiently high to preclude movement as the result of inadvertent bumping or jarring.

The joystick 30 includes an elongated body or shaft 32 that supports an oversized head 34. The head 34 includes a generally rounded or hemispherical upper portion 34*a* adapted for being comfortably received in the cupped hand of the operator, generally in engagement with the palm. A generally tapered or frusto-conical lower portion 34*b* of the head 34 provides support for the upper portion 34*a* and serves as the interface with the shaft 32. As a result of the frusto-conical shape, the lower portion 34*b* provides a flat, slightly recessed resting place for the tips of the operator's fingers when the corresponding hand is positioned adjacent to the joystick 30, such as during manual engagement. The upper and lower portions may be secured together via fasteners F. As shown in FIG. 2, the heads of the fasteners F may be recessed in the upper portion 34*a* to ensure maximum operator comfort.

In accordance with one aspect of the invention, the input device 12 includes an enable switch 36 for preventing inadvertent actuation of the actuator 16 (i.e., the motors 18, 20). In the most preferred embodiment, as shown in FIG. 2, the enable switch 36 is normally open and associated with a trigger or button 38 provided on the joystick 30. This positioning is desirable, since it allows the operator to simultaneously engage both structures using a single hand. As also shown in FIGS. 2 and 2*a*, the button 38 may be a low-profile, generally semi-circular piece of material positioned in a slot 37 formed at the interface between the upper portion 34*b* and the frusto-conical, lower portion 34*a* of the head 34. In the home position, the button 38 projects from the slot 37. Accordingly, when the palm of the operator's hand is resting on or adjacent to the head 34, one or more fingers overlie the button 38 (which as shown in FIG. 2 preferably has a rounded face 38*a* to ensure comfort). This allows for the button 38 to be depressed or engaged in a simple fashion, such as by simply squeezing the head 34 of the joystick 30.

The button 38 serving as the trigger is preferably biased toward a non-engaged or home position by a spring or like biasing means (not shown) positioned within the head 34. As is the case with the joystick 30, the biasing force supplied should be low enough that it is easily overcome by finger action. However, it should not be sufficiently high to prevent inadvertent actuation, such as by being bumped or jarred by the operator or contacted by a falling object.

FIGS. 4*a*-4*d* show an alternate embodiment of a head 40 for the joystick 30. This head 40 is comprised of two mating halves 40*a*, 40*b* secured together by a fastener F. The mated halves 40*a*, 40*b* form a receiver 42 for a shaft (not shown) carrying a torsion spring 44. These halves 40*a*, 40*b* also provide support for a pivot pin 46 carrying a trigger in the form of a button 48. The button 48 is normally biased outwardly by the spring 44, and carries a magnet 48*a*. An adjacent magnetically activated switch 49 (preferably zero volume) actuates upon engaging the magnet 48*a* when the button 48 is pressed (in which case a signal propagates along line L). The button 48 in this embodiment thus associates with the enable switch 36. The use of a magnetically actuated switch is preferable, since it is resistant to the effects of water and dust.

As briefly noted above, movement of the joystick 30 from a neutral or home position results in the opening of the control valve 22 and the closing of one or both of the neutral switches 24. However, unless the enable switch 36 is closed (such as by depressing the button 38 or 48) before the joystick 30 is moved from the neutral position (as determined by the closing of the neutral switch(es) 24), the controller 14 does not actuate (energize) the valve package 21. Consequently, no flow to the valve 22 results. In other words, if the joystick 30 moves from the neutral position before the enable switch 36 is closed (i.e., before the button 38 is engaged), the controller 14 does not signal the valve package 21 to allow additional fluid flow to reach the corresponding valve 22 (which means that the feed or rotation motors 18, 20 do not actuate).

Likewise, if the enable switch 36 is closed while the joystick 30 is moved from the neutral position, no actuation occurs even if the joystick is returned to the neutral position with the enable switch closed and then moved from the neutral position again with the switch closed. However, the logic arrangement in the controller 14 may be such that, once the joystick 30 is moved from the neutral position with the enable switch 36 closed, it thereafter may be opened (such as by releasing the button 38 or 48) without incident.

To prevent the operator from defeating the function provided by the enable switch 36 (such as by jamming the button 38 or 48 in the engaged position), the system 10 may include a "watchdog" circuit 50 (see FIG. 1). This circuit 50 checks at a predetermined interval (e.g., every five seconds) the condition of the enable switch 36, such as to see if it is open. If the switch 36 does not open after one or more of the intervals pass (the number required may be varied), the controller 14 may act to prevent flow to the valve 22.

Figure 5:
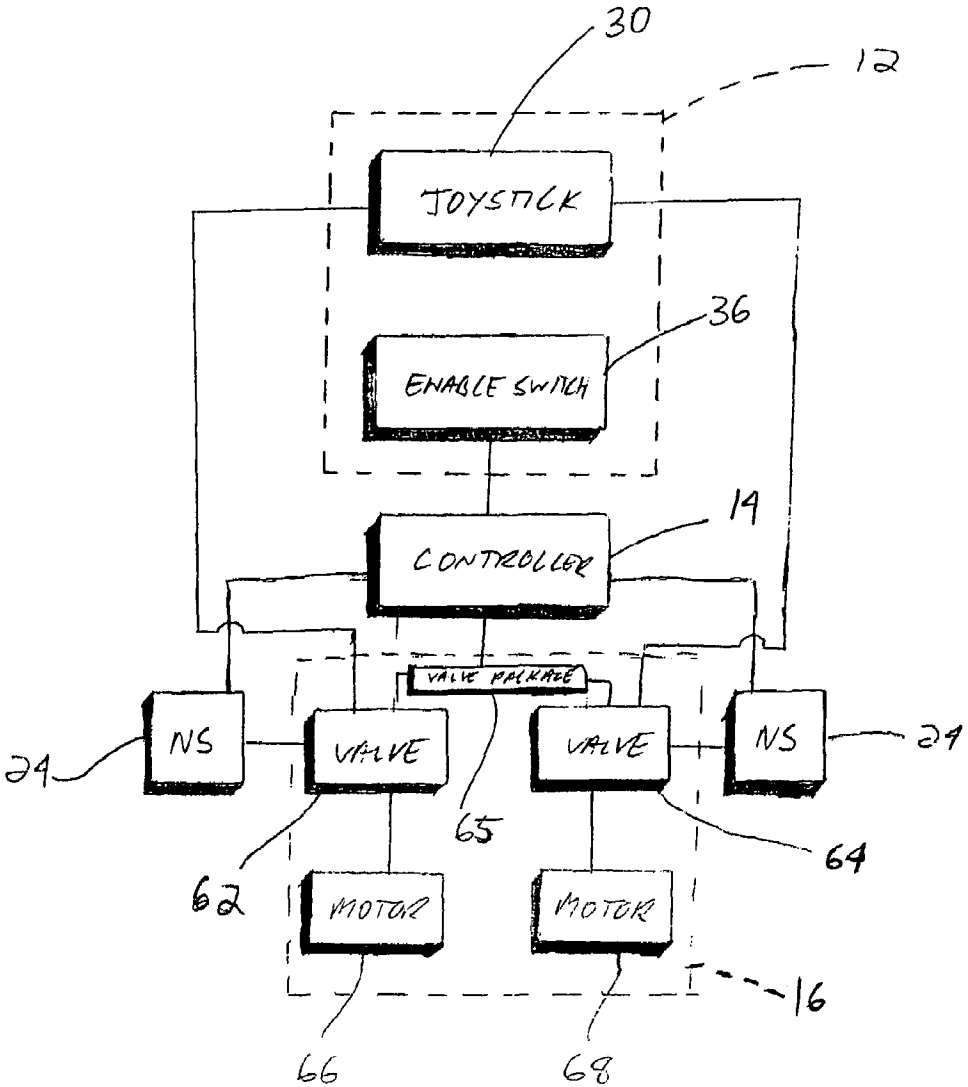
FIG. 5 schematically illustrates a control system forming another aspect of the invention.

In accordance with a second aspect of the invention, and as shown in FIG. 5, a similar arrangement of neutral switches 24 may also be used in conjunction with a controller 14 and an actuator 16 associated with the valve or valve sections 62, 64 that supply the fluid for operating the hydraulic motor(s) 66, 68 used to move or "tram" the drilling or bolting machine. In this arrangement, the controller 14 prevents the machine from starting or moving until the valve sections 62, 64 are in the neutral position (which is accomplished by moving a corresponding manual input device 12 (i.e., a joystick, lever, or handle) to the neutral position), as determined by the neutral switches 24. This guards against unexpected movement of the machine at power up in the event the input device 12 is not in the neutral position (in other words, if the input device 12 is jammed in a position that would cause movement in the forward direction and an attempt is made to start the machine).

As also shown in FIG. 5, an enable switch 36 of the type described above may also be used in conjunction with the neutral switches 24 for preventing a valve package 65 upstream of the valve sections 62, 64 from opening. As above, the enable switch 36 may be associated with the input device 12, preferably on the handle, lever, or joystick used to control the movement (tramming) of the machine. The controller 14 requires the closing of the enable switch 36 when the input device 30 is in a neutral or home position before actuation. The controller 14 also does not signal the valve package 65 to open when the enable switch 36 is closed after the input device 12 is moved from the home or neutral position. However, once the signal is generated to open the valve package 65, the enable switch 36 may be opened without incident. A watchdog circuit (not shown) similar or identical to the one described above may also form part of the controller 14 to ensure that the enable switch 36 is not defeated.

FIGS. 6*a*-6*e* illustrate an alternative input device 12 in the form of a lever 30 that may be used to control simultaneously two distinct valve sections 22*a*, 22*b*. The lever 30 includes a first linkage 70 extending between a body or shaft 32 and a valve spool 23*a* associated with a first valve section 22*a*. A second, generally transverse linkage 72 extends between the body 32 and a post 74. A pivotally mounted connector 76 connects the post 74 to a second valve spool 23*b* associated with a second valve section 22*b*. Both the post 74 and lever 30 are mounted using ball joints 78 to permit movement along at least two different axes in the same plane.

As should be appreciated, the input device 12 of this embodiment allows for simultaneous control of two different valve spools 23*a*, 23*b* using the same input device 30 (lever). More specifically, the second linkage 72 is rotatable about the shaft 32 such that it moves to and fro when the lever 30 is manipulated (pivoted) in a first direction ($D_1$ in FIG. 6*e*) to pull the first linkage 70 and open the first valve spool 23*a*. However, this movement of the lever 30 does not open the second valve spool 23*b*, since the post 74 simply pivots as a result of the ball joint 78.

Movement of the lever 30 to the left (that is, in a second direction $D_2$ perpendicular to the first direction) causes the connector body 76 to pivot about a pivot point P defined by a clevis 78 connected to a support structure 80 (see action arrow A in FIG. 6*d*), which causes the corresponding valve spool 23*b* to move in a direction parallel to the other spool 23*a* and open. The result is the same even when the lever 30 is first pivoted such that the first valve spool 23*a* is opened. Pivoting of the lever 30 to the right likewise causes the second valve spool 23*b* to move to a position such that flow through the corresponding valve section 22*b* may be reversed. Forward movement of the lever 30 likewise may cause the first valve spool 23*a* to move to a reverse-flow position, and combined left or right movement results in a corresponding repositioning of the second valve spool 23*b*.

As should be appreciated, by associating the first valve spool 23*a* with drill head rotation and the second valve spool 23*b* with feed, it is possible to commence the former without the latter. However, both feed and rotation may result by pulling the lever 30 back and then moving it to the left. Likewise, rotation and feed can be simultaneously reversed by moving the lever forward and to the right. Other combinations are of course possible in light of the foregoing description. By using neutral switches and providing an enable switch on the input device, this arrangement may also be used in conjunction with the controller 14 to create a lockout condition unless the switches are actuated in a certain sequence, as outlined in detail in the foregoing description.

As should be appreciated, any of the above manual operator input devices may be retrofitted onto an existing drilling or bolting machine to replace the existing input device. Any adjustments necessary to provide a corresponding controller can also be made to implement the overall control systems disclosed.

The foregoing descriptions of various embodiments of the invention are provided for purposes of illustration, and are not intended to be exhaustive or limiting. Modifications or variations are also possible in light of the above teachings. For example, other manual input devices, such as those including simple proximity switches for detecting the presence of the operator near the controller (see, e.g., U.S. Pat. No. 6,501,198, the disclosure of which is incorporated herein by reference) may be used instead of those described. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A system for controlling a drilling or bolting operation, comprising:

an input device for manually controlling at least one aspect of the drilling or bolting operation;

a controller associated with at least one neutral switch; and an actuator for actuating the drilling or bolting operation, the actuator including a valve associated with the input device and the neutral switch;

wherein the input device is operative for controlling the drilling or bolting operation only when the valve is in a neutral position according to the neutral switch.

2. The system according to claim 1, wherein the manual input device includes an enable switch associated with the controller.

3. The system according to claim 2, wherein the manual input device is operative for controlling the drilling or bolting operation only when the valve is in the neutral position and the enable switch is closed.

4. The system according to claim 3, wherein the enable switch may be opened without rendering the manual input device inoperative once the valve is moved from the neutral position with the enable switch closed.

5. The system according to claim 2, wherein the manual input device is operative for controlling the drilling or bolting operation only when the enable switch is closed before the valve is moved from the neutral position.

6. The system according to claim 2, wherein the controller includes a circuit for evaluating whether the enable switch is open or closed at predetermined intervals, wherein the input device is rendered inoperative for controlling the drilling or bolting operation if the controller determines that the enable switch is closed for a predetermined number of intervals.

7. The system according to claim 2, wherein the manual input device is a joystick associated with the valve and the enable switch is closed by a trigger associated with the joystick.

8. The system according to claim 2, wherein the manual input device is for use by a single hand of an operator having a palm and fingers, said device comprising:

a support;

a head associated with the support and including an upper portion and a lower portion defining an interface; and a low-profile trigger associated with the enable switch and positioned adjacent the interface, the trigger including a body having a generally semi-circular face for engagement by at least one of the operator's fingers when the palm is positioned on or generally adjacent the upper portion of the head.

9. The system according to claim 8, wherein the upper portion is hemispherical, the lower portion is frusto-conical, and the two portions are secured together using fasteners recessed in the upper portion.

10. The system according to claim 8, wherein the face of the trigger is rounded from a top edge to a bottom edge of the body.

11. The system according to claim 8, wherein a slot is defined at the interface and a portion of the trigger body projects through the slot in a home position and when the enable switch is in an open condition.

12. The system according to claim 11, further including a spring for biasing the trigger toward the home position.

13. The system according to claim 1, wherein the actuator includes a valve package for selectively permitting a fluid flow to reach the valve once the controller determines that: (1) an enable switch associated with the input device is closed; and (2) the neutral switch is closed.

14. A drilling or bolting machine including the system of claim 1, wherein the actuator includes at least one fluid-operated motor for controlling a feed or a rotation of either: (1) a drill bit for performing the drilling operation; or (2) a roof bolt used in the bolting operation.

15. A method of drilling or bolting, comprising controlling the drilling or bolting operation to form a borehole or install a roof bolt in the borehole once formed with the system of claim 1.

16. The system according to claim 1, wherein the manual input device is for use by a single hand of an operator having a palm and fingers, comprising:

a support;

a head associated with the support and including first and second separable portions defining an interface;

a trigger pivotally mounted adjacent the interface, the trigger including a magnet and a face for engagement by at least one of the operator's fingers when the palm is positioned on or generally adjacent the head; and a magnetically-actuated switch associated with the head and the magnet of the trigger in an actuated position, whereby the presence of dust or water adjacent the head does not impair actuation of the switch by the trigger.

17. The system according to claim 16, further including a spring for biasing the trigger toward a non-actuated position.

18. A drilling or roof bolting machine including the system of claim 16, and wherein the actuator includes at least one motor for controlling a feed or a rotation of either: (1) a drill bit for performing the drilling operation; or (2) a roof bolt used in the bolting operation.

19. A method of drilling or bolting comprising controlling the drilling or bolting operation to form a borehole or install a roof bolt in the borehole once formed with the system of claim 16.

20. A method of retrofitting an existing drilling or bolting machine, comprising replacing an existing control system including a manual operator input device with the system of claim 1.

21. A system for controlling a machine for use in performing a drilling or bolting operation, comprising:

a fluid-operated motive device for moving the machine;

a valve for controlling fluid flow to the motive device;

an input device for manually controlling the position of the valve;

a neutral switch associated with the valve; and wherein the motive device is capable of moving the machine only when the valve is in a neutral position according to the neutral switch.

22. The system according to claim 21, wherein the input device includes an enable switch, and wherein the motive device is capable of moving the machine only when the enable switch is closed before the neutral switch is closed.

23. A method of drilling or bolting using the machine including the system of claim 21 comprising controlling the drilling or bolting operation to form a borehole or install a roof bolt in the borehole once formed.

24. The system according to claim 21, wherein the manual input device is for controlling a position of first and second valve spools, said device comprising:

a lever;

a first ball joint supporting the lever;

a first linkage connecting the lever to the first spool; and a second linkage connecting the lever to the second spool;

wherein movement of the lever to and fro in a first direction results in corresponding movement of the first spool and movement of the lever to and fro in a second direction results in corresponding movement of the second spool.

25. The system according to claim 24, wherein the movement in the first direction and the movement in the second direction occurs simultaneously.

26. The system according to claim 24, wherein the movement in the first direction occurs before the movement in the second direction.

27. The system according to claim 24, wherein the first and second directions are generally perpendicular and the first and second spools move generally parallel.

28. A drilling or bolting machine including the system of claim 24 and further including at least one motor associated with the manual input device for controlling a feed or a rotation of either: (1) a drill bit for performing the drilling operation; or (2) a roof bolt used in the bolting operation.

29. The machine according to claim 28, wherein the first spool is associated with a rotation valve section for controlling a flow of fluid to a rotation motor adapted for rotating a drill bit or roof bolt and the second spool is associated with a feed valve section for controlling a flow of fluid to a feed motor for feeding the drill bit or roof bolt.

30. A method of retrofitting an existing drilling or bolting machine, comprising replacing an existing manual operator input device with the system of claim 21.

31. A control system for controlling a drilling or bolting machine, comprising:

a joystick for manually controlling at least one aspect of the drilling or bolting machine;

a controller associated with at least one neutral switch and at least one enable switch; and an actuator for actuating the drilling or bolting machine, the actuator including a valve associated with the joystick and the neutral switch;

wherein the joystick is operative for controlling the drilling or bolting machine only if the enable switch is closed before closing the neutral switch by the valve using the joystick.

* * * * *